US005491966A

United States Patent [19]

Billner

[11] Patent Number: 5,491,966

[45] Date of Patent: Feb. 20, 1996

[54] PROCESS AND DEVICE FOR OPEN-END SPINNING

[75] Inventor: Werner Billner, Ingolstadt, Germany

[73] Assignee: Rieter Ingolstadt Spinnereimaschinenbau AG, Ingolstadt, Germany

[21] Appl. No.: 185,907

[22] PCT Filed: Jun. 16, 1993

[86] PCT No.: PCT/DE93/00517

§ 371 Date: Jun. 21, 1994

§ 102(e) Date: Jun. 21, 1994

[87] PCT Pub. No.: WO94/01605

PCT Pub. Date: Jan. 20, 1994

[30] Foreign Application Priority Data

| | | | |
|---|---|---|---|
| Jul. 1, 1992 | [DE] | Germany | 42 21 179.4 |
| Jul. 25, 1992 | [DE] | Germany | 42 24 687.3 |
| Mar. 12, 1993 | [DE] | Germany | 43 07 785.4 |

[51] Int. Cl.[6] ..... D01H 4/38

[52] U.S. Cl. ..... 57/413

[58] Field of Search ..... 57/408, 411, 413

[56] References Cited

U.S. PATENT DOCUMENTS

| | | | |
|---|---|---|---|
| 3,538,698 | 11/1970 | Ripka et al. | 57/413 |
| 3,624,995 | 12/1971 | Rajnoha et al. | 57/413 X |
| 3,785,138 | 1/1974 | Rajnoha et al. | 57/413 |
| 3,968,636 | 7/1976 | Junek et al. | 57/413 |
| 4,014,162 | 3/1977 | Stahlecker . | |
| 4,291,528 | 9/1981 | Miyamoto et al. | 57/413 X |
| 4,393,648 | 7/1983 | Rambousek et al. | 57/413 |
| 4,769,984 | 9/1988 | Raasch et al. | 57/413 X |
| 4,879,873 | 11/1989 | Kawabata et al. | 57/413 |
| 4,903,474 | 2/1990 | Stahlecker | 57/413 |
| 5,065,572 | 11/1991 | Stahlecker | 57/413 |
| 5,111,651 | 5/1992 | Pohn et al. | 57/413 |

FOREIGN PATENT DOCUMENTS

| | | | |
|---|---|---|---|
| 311988 | 4/1989 | European Pat. Off. | 57/413 |
| 3734544C2 | 7/1991 | Germany . | |
| 4123255 | 1/1993 | Germany | 57/413 |
| 1358810 | 7/1974 | United Kingdom . | |
| 2192010 | 12/1987 | United Kingdom . | |

*Primary Examiner*—Joseph J. Hail, III
*Attorney, Agent, or Firm*—Dority & Manning

[57] ABSTRACT

In open-end spinning, the fibers coming from an opener unit, upon leaving a fiber feeding channel (3), are conveyed to a fiber guiding surface (10) and then to a fiber collection groove (11) of a rotating spinning rotor (1) in which the fibers are deposited and are then spun into the end of a continuously withdrawn yarn. In this spinning process, the fibers coming out of the fiber feeding channel (3) are first compressed essentially in one plane and are at the same time spread out in the direction of rotation of the spinning rotor (1) to be then fed onto a portion of the circumference of the spinning rotor (1) in the form of a thin veil. To carry out this process, the wall of the last longitudinal segment (30) which is a continuation of the next-to-last longitudinal segment (31) of the fiber feeding channel (3) is made in the form of a fiber distribution surface (300) which extends substantially at a perpendicular to the plane passing through the center lines (310, 301) of the two above-mentioned longitudinal segments (31, 30). The last longitudinal segment (30) of the fiber feeding channel (3) may let out into a radial slit (6) which is provided with a surface (60) for the spreading out of fibers extending towards the fiber guiding surface (10) and which is across from the fiber distribution surface (300).

15 Claims, 7 Drawing Sheets

PROCESS AND DEVICE FOR OPEN-END SPINNING

BACKGROUND OF THE INVENTION

The present invention relates to a process for open-end spinning in which the fibers coming from an opener device, after leaving a fiber feeding channel are conveyed to a surrounding spinning rotor with a sliding wall and a fiber collection groove in which the fibers are deposited in the fiber collection groove and are then spun into the end of a continuously withdrawn yarn, as well as to a device to carry out this process.

In a known open-end spinning device, the fiber feeding channel is subdivided into several longitudinal segments positioned at an angle to each other in adaptation to different rotor diameters (DE 37 34 544 A1), however without any special measures being taken to optimize the fiber depositing on the fiber collection surface of the spinning rotor. As a consequence, different yarn qualities are produced, depending on rotor diameter and the deflection of the fibers selected as a function thereof.

OBJECTS AND SUMMARY OF THE INVENTION

It is therefore a principal object of the instant invention to improve the feeding of the fibers into the spinning rotor so that the disadvantages mentioned are avoided and yarns of high quality are produced. Additional objects and advantages are set forth in the following description, or maybe obvious from the description, or may be learned through practice of the invention,.

The objects are achieved according to the invention in that fibers emerging from the fiber feeding channel are at first compressed substantially in one plane as they spread out in the circumferential sense of the spinning rotor and are at the same time spread out in the circumferential sense of the spinning rotor to be then fed in the form of a thin veil over part of the circumference of the spinning rotor, i.e. on its sliding wall. As a result of the compression of the fiber stream, the fibers are deposited substantially at one contour line of the sliding wall of the spinning rotor along which they slide in order to finally enter the fiber collection groove. Furthermore the fiber stream is spreading out in the circumferential sense whereby the speed is being reduced. The air which is deflected in the spinning rotor towards its open edge is thereby decelerated so that its influence on the fibers decreases and the danger that fibers may be pulled along by the air and be removed over the open rotor edge is reduced considerably. The spreading out of the fibers prevents the flight paths of the fibers leaving the fiber feeding channel from crossing each other so that this type of fiber feeding makes it possible to obtain a substantially orderly fiber deposit on the sliding wall.

Provisions are preferably made for the fibers to be compressed parallel to the plane passing through the fiber collection groove.

In principle, the fibers can also be fed to the sliding wall along a conical surface preceding the sliding wall. The air must thus be deflected very strongly for its removal, so that particularly good separation of fibers and air is achieved. A simpler design and more precise feeding of the fibers on the sliding wall can be achieved according to the invention in that the fibers emerging from the fiber feeding channel are conveyed parallel to the plane passing through the fiber collection groove as they spread out.

The fibers are preferably fed to the sliding wall of the spinning rotor in proximity of the open rotor edge. Surprisingly it has been shown that yarn values are optimized in this manner.

It has been shown that it may be advantageous for the improvement of the spreading of the fibers if the fibers emerging from the fiber feeding channel are subjected to a bunched air stream.

Particularly good spinning results are achieved if the air emerging from the fiber feeding channel according to the invention is guided into proximity of the sliding wall of the spinning rotor.

The objects of the invention are attained with respect to a device in an open-end spinning device with a spinning rotor and a fiber feeding channel having at least two longitudinal segments, whose center lines are at an angle to each other and of which the last longitudinal segment in the fiber conveying direction ends across from a fiber guiding surface in that the wall of the last longitudinal segment provided in prolongation of the next-to-last longitudinal segment of the fiber feeding channel is made in the form of a fiber distribution surface which extends essentially at a perpendicular to the plane passing through the center line of the two above-mentioned longitudinal segments. This configuration of the fiber feeding channel causes the fibers— by contrast to the state of the art in which the fibers are collected in the form of a concentrated fiber stream because of the concave configuration of this wall—to spread out on the fiber distribution surface extending transversely to the above-defined plane. This spreading reduces the danger that the fibers may hinder each other during their transportation into the spinning rotor. This leads to more uniform yarns of greater strength.

Depending on the width of the fiber distribution surface and its placement in relation to the longitudinal segment of the fiber feeding channel which precedes it, it is especially advantageous for the fiber distribution surface to be designed as a plane surface, but it has been shown that, especially with small widths or narrow deflection angle, the spreading out of the fibers can also be facilitated in that the fiber distribution surface is made in form of a concave surface.

Preferably the fiber distribution surface widens gradually as the distance from the next-to-last longitudinal segment of the fiber feeding channel increases.

In an advantageous embodiment of the invention, the length of the fiber distribution surface can be selected so as to be at most equal to the average staple length of the fibers to be spun. While the spreading out of the fibers is improved, this nevertheless prevents the fibers sliding along the fiber distribution surface from being braked excessively. In order to counteract such a braking effect, the outlet opening of the fiber feeding channel can be tapered along the above-mentioned plane.

In order to optimize the desired fiber spreading effect, provisions are made in an advantageous further development of the invention for the fiber distribution surface to be placed with respect to the next-to-last longitudinal segment of the fiber feeding channel so that the axial projection of the next-to-last longitudinal segment of the fiber feeding channel falls fully on the fiber distribution surface of the fiber feeding channel. The fiber guiding surface to which the fibers are conveyed may be part of a guiding funnel extending into the open side of the spinning rotor. Preferably however, the fiber guiding surface is part of the spinning rotor and is constituted by its inner wall.

In order to avoid damming up of the fibers, the angle between the two above-mentioned longitudinal segments of the fiber feeding channel should not be too wide. It has been shown that good results are achieved if the two last longitudinal segments of the fiber feeding channel are at an angle between 10° and 30°.

To ensure centered conveying of the fibers on the fiber distribution surface so that optimal fiber distribution may be achieved, it is advantageous if the center line of all longitudinal segments are in one and the same plane.

It has been shown that an intensification of fiber distribution in the circumferential sense of the spinning rotor can be achieved in that the last longitudinal segment of the fiber feeding channel lets out into a radial slit with a fiber spreading surface extending towards the fiber guiding surface and located across from the fiber distribution surface.

In an alternative embodiment of the device according to the invention, and in an open-end spinning device with an opener unit, a spinning rotor with a fiber collection groove, a sliding wall extending from the fiber collection groove to an open edge, a fiber feeding channel extending from the opener unit into the spinning rotor and letting out in a recess which is open towards the sliding wall of the spinning rotor, the recess is made in the form of a radial slit whose height (measured parallel to the rotor axis) is less near its outlet opening than the height of the fiber feeding channel and extends over a substantial portion of the circumference of the spinning rotor. This makes it possible for the fibers to be conveyed to the sliding wall in the form of a thin veil and for the air to be safely separated from the fibers.

A "radial slit" should not be understood only as a slit extending along a plane which is at a right angle to the rotor axis. In the sense of the instant invention, the term also relates to slits which extend along a plane which is inclined in relation to the above-mentioned plane or which are delimited by conical surfaces. It is only essential for the function of such a slit that it should be able to guide fibers against the sliding wall of the spinning rotor or against some other fiber guiding surface with a component that is radial in relation to the rotor axis. Since the fibers are hurled against the fiber distribution surface and/or the fiber spreading surface, these surfaces, or at least one of them, are provided with greater wear protection so that life and operating time of these surface may be increased.

The height of the outlet opening of the radial slit is preferably smaller with lower yarn numbers than with larger yarn numbers. This makes it possible to provide an optimal slit at all times, depending on the fiber through-put.

In a preferred embodiment of the device according to the invention, the placement of the outlet opening of the fiber feeding channel relative to the radial slit, in order to obtain an especially narrow fiber veil, is such that the projection of the last longitudinal segment of the fiber feeding channel falls fully into fiber spreading surface of the radial slit across from the fiber feeding channel.

In principle, the slit may taper from the spot where the fiber feeding channel lets out in it towards the outlet opening, but it has been shown that especially good spinning results are achieved if the radial slit is provided with two parallel guiding surfaces intersecting the rotor axis at a distance from each other. It is especially advantageous here for the two guiding surfaces to extend parallel to the plane passing through the fiber collection groove.

To ensure that the fibers follow the longest possible sliding path from the feeding contour line to the fiber collection line, as this has an advantageous effect on fiber straightening, the radial slit lets out into the spinning rotor in proximity of the latter's open edge according to a preferred embodiment of the invention. It has been shown to be advantageous here for the distance—as measured parallel to the rotor axis— of the guiding surface of the radial slit which is away from the plane going through the fiber collection groove to the open edge of the spinning rotor-to be equal to at least one third of the height of the outlet opening of the radial slit.

A long slit (in relation to the rotor circumference) is required for the fibers to spread out well in the direction or rotation. According to the invention, it therefore extends over at least half the rotor circumference. The radial slit is here advantageously delimited by side walls extending substantially parallel to the rotor axis and radially into proximity of the sliding wall of the spinning rotor before and after the outlet opening of the fiber feeding channel.

It has been shown that it may be advantageous under certain operating conditions if the radial slit, as seen in the direction of rotor rotation, begins already at a distance from and before the inlet of the fiber feeding channel into the radial slit.

In order to achieve a substantial reduction of air speed in addition to good fiber spreading, provisions may be made in a further advantageous development of the device according to the invention for the outlet cross-section of the radial slit to be several times greater than the cross-section of the inlet opening of the fiber feeding channel into the radial slit.

The radial slit is preferably delimited either by two essentially straight side walls connected to each other by a convex surface, or by convex side walls with changing convexity. In the latter case, the convexity increases essentially up to the outlet opening of the fiber feeding channel and then decreases again in an advantageous embodiment of the invention.

In order to avoid air turbulence which would have an adverse effect on fiber transportation to the sliding wall and on fiber depositing on the same, it is advantageous for the side walls of the radial slit to merge in an arc into a connecting wall extending concentrically with the rotor axis.

Outside the area of the radial slit into which the fiber feeding channel lets out, a delimitation constituting the side walls of the radial slit is advantageously provided, extending over the area which, in relation to the rotor axis, is diametrically opposed to the outlet opening of the fiber feeding channel. This slit delimitation may optionally extend before, as well as after, the outlet opening of the fiber feeding channel (as seen in rotating direction of the spinning rotor), more or less in the direction of the outlet opening of the fiber feeding channel.

It has been shown that under certain operating conditions, particularly good spinning conditions are achieved if an air conduit lets out from behind (as seen in the direction of rotor rotation) into the radial slit. The air conduit may be separated by a wall from the inner space surrounded by the fiber guiding surface between its inlet opening across from the fiber guiding surface and the inlet of the fiber feeding channel into the radial slit.

To be able to realize the invention on machines that have already been delivered, provisions may be made for the radial slit to be delimited in the axial direction and laterally by replaceable elements.

To prevent fibers from being caught at the separation gaps between the replaceable element and the rotor cover which serves as its support, such separation gaps are located according to the invention outside the range of flying fibers.

This is achieved advantageously in that the replaceable element presses against a rotor cover covering the spinning rotor and containing at least the last longitudinal segment of the fiber feeding channel with the first fiber distribution surface, at the end of the radial slit towards the fiber feeding channel. In an advantageous embodiment of the invention, the replaceable element can be slid over a part containing a yarn draw-off channel.

In an alternative advantageous further development of the device according to the invention, the side walls delimiting the radial slit contain between them a ridge on the side away from the radial slit, this ridge being connected by means of an attachment extending radially outward and which is recessed in a recess of the rotor housing cover and is connected to the rotor housing cover to the part of the replaceable element which contains the second fiber distribution surface. To achieve a simple design, the attachment is advantageously provided with radial walls which are placed in prolongation of the side walls delimiting the radial slit.

To prevent circulating fibers from being caught, the radial walls of the attachment and the walls of the recess adjoining the radial walls are advantageously provided with rounded edges on their side towards the spinning rotor.

As mentioned earlier, it is advantageous for the height of the outlet opening of the radial slit to be adapted to the yarn number. This can be done in that the radial slit is located in a replaceable element. According to another advantageous embodiment of the device according to the invention, the height of the radial slit is adjustable. To fix the adjusted height, a spacer of desired thickness can be inserted between an attachment of an element delimiting the radial slit in axial direction and a part supporting this element.

The radial slit is advantageously delimited in the axial direction by an element with at least one guiding wall extending in the radial direction and interacting with an opposing wall and which can be adjusted in the axial direction by means of an adjusting element.

In order to fix the replaceable element in a precisely defined position in relation to the part which supports this replaceable element, e.g. the rotor housing cover, and in order to close the separations between the replaceable element and the part which supports this element so that no fibers may be caught, the replaceable element may be connected to the part which supports it by means of connecting elements designed to exert a pressure in the direction of the interacting guiding walls of the replaceable element and the part which supports this element.

The device according to the invention is of simple construction and can be retrofitted also into conventional open-end spinning devices, in which case it generally suffices to replace the rotor cover covering the spinning rotor. The fibers fed to the spinning rotor are spread out in the circumferential sense of the spinning rotor and are fed in the form of a more or less wide fiber veil to the fiber guiding surface. This spreading out of the fibers reduces the risk of fibers affecting each other detrimentally. The frequency of fiber accumulation and fiber ravelling is reduced. The fibers are deposited based on the spreading out of fibers, essentially at a defined distance from the fiber collection groove so that the sliding paths of the fibers sliding along the fiber guiding surface towards the fiber collection groove do not cross. This leads to a further improved depositing of the fibers in the fiber collection groove of the spinning rotor. The optimized fiber deposit on the fiber guiding surface also reduces the danger of freely flying fibers being caught by the yarn being drawn off and being spun into it without having first been deposited in the fiber collection groove. The result of this optimized fiber deposit is a yarn of great uniformity, greater strength and greater stretchability. Other parameters determining yarn quality are also improved by the instant invention, in particular with fine yarn. Examples of embodiments of the object of the invention are explained below through drawings.

DETAILED DESCRIPTION OF THE PREFERRED EMBODIMENTS

Figure 1:
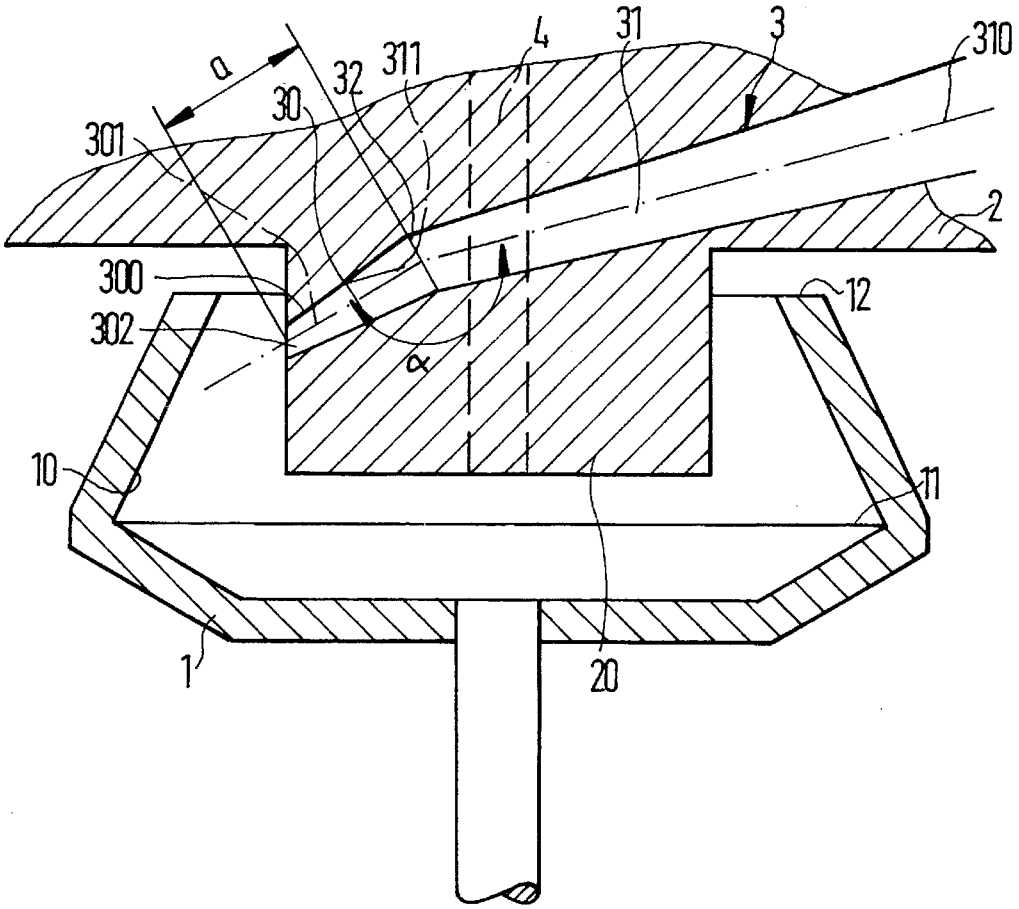
FIG. 1 shows an open-end spinning rotor, as well as part of a rotor cover, with a fiber feeding channel designed according to the invention, in longitudinal section.

Reference will now be made in detail to the presently preferred embodiments of the invention, one or more examples of which are illustrated in the drawings. Each example is provided by way of explanation of the invention, not limitation of the invention. Additionally, the numbering of components in the drawings and description is consistent, with the same components having the same number throughout.

Figure 8:
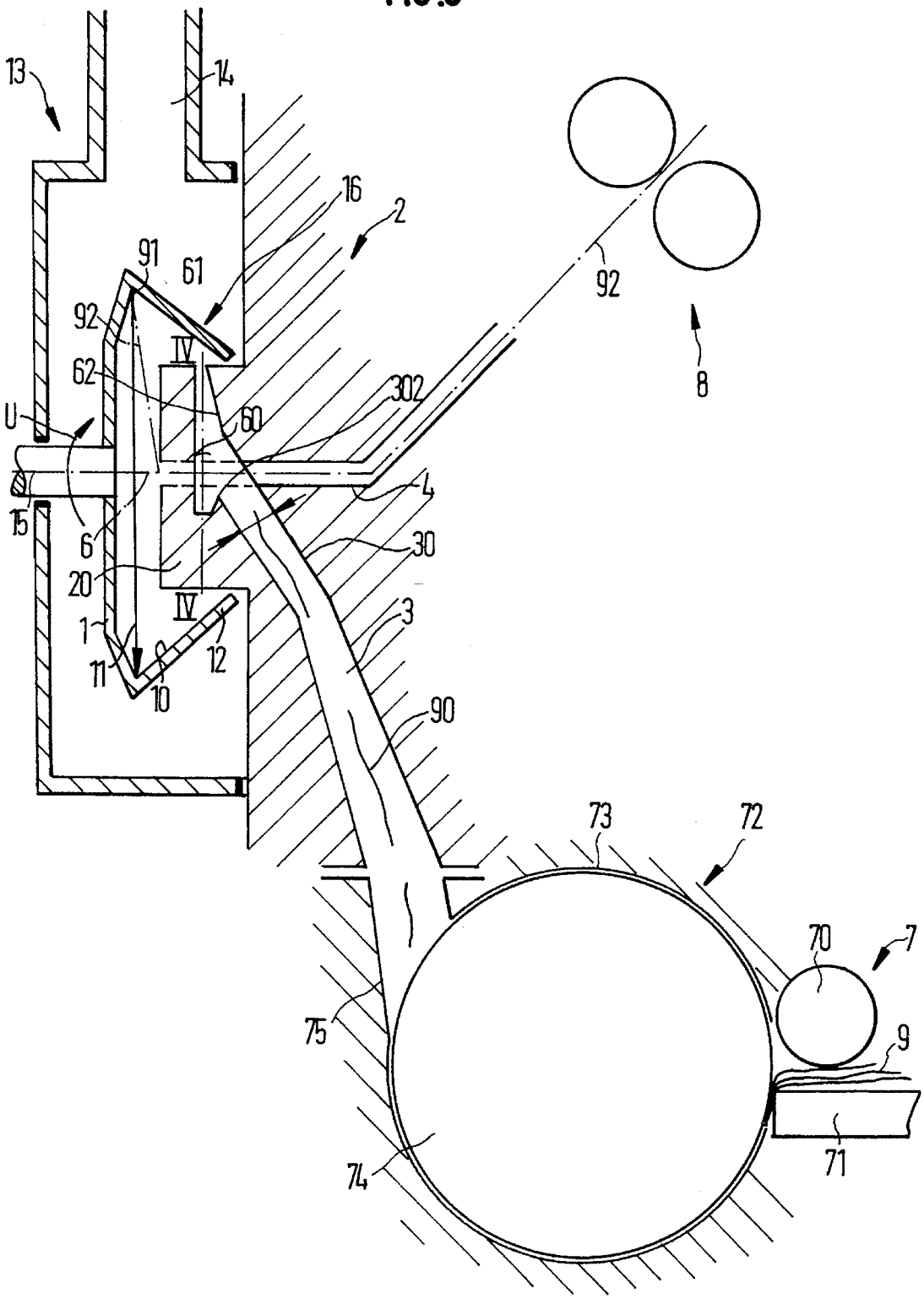
FIG. 8 shows another open-end spinning device according to the invention, in cross-section.

The invention shall first be explained through FIGS. 1 and 8 which show only those elements which are relevant for the explanation of the invention.

FIG. 8 schematically shows an open-end spinning device consisting in a known manner of a feeding device 7, an opener unit 72, a rotor housing cover 2, a rotor housing 13, as well as of a draw-off device 8.

The feeding device 7 consists in the embodiment shown of a delivery roller 70 with which a feeding trough 71 interacts elastically.

The opener unit 72 is provided with a housing 73 in which a opener roller 74 is located.

The rotor housing cover 2 covering the open side of the spinning rotor 1 contains a fiber feeding channel 3, the beginning 75 of which is located in the housing 73 of the opener unit 72. The fiber feeding channel 3 ends in a cylindrical or conical extension 20 which extends in a centered manner into a spinning rotor 1 located in the rotor housing 13. The extension 20 contains a fiber draw-off channel 4, coaxially to the spinning rotor 1.

The rotor housing 13 is connected via a line 14 to a source of negative pressure which is not shown and which produces negative pressure in the spinning rotor 1 during operation. The spinning rotor 1 is equipped with a fiber guiding surface 10 made in the form of a sliding wall which extends from the open edge 12 of the spinning rotor 1 to a fiber collection groove 11.

During normal spinning operation the feeding device 7 feeds a fiber sliver 9 to the opener roller 7 which opens this fiber sliver 9 into individual fibers 90 which are introduced by means of a fiber/air stream into the spinning rotor 1 from which the fibers 90 then separate and slide along the inner wall of the spinning rotor constituting a sliding wall and fiber guiding surface 10 into its fiber collection groove 11. The fibers 90 accumulate therein and constitute a fiber ring 91 which is incorporated in the usual manner into the end of a yarn 92 which is constantly being drawn off and which leaves the spinning rotor 1 through the fiber draw-off channel 4 and is wound up on a bobbin not shown here.

Normally, provisions are made for the fibers 90 to leave the fiber feeding channel 3 in the form of a bunched fiber/air stream which is directed against the fiber guiding surface 10. The fibers 90 assume normally a random position inside the fiber feeding channel 3 or collect as a function of the geometry of the fiber feeding channel 3 against one of the concavely curved inner sides of the fiber feeding channel 3. The fibers 90 thereby leave the fiber feeding channel 3 at different levels relative to the spinning rotor 1 (along the fiber guiding surface 10) and therefore come into range of the sliding paths of other fibers 90 as they slide down along the fiber guiding surface 10. As a result, the fibers impede each other as they slide down into the fiber collection groove 11. This is also the case when the fibers 90 reach the sliding wall (fiber guiding surface 10) of the spinning rotor 1 in a bunched stream.

To avoid these disadvantages, provisions are made according to FIG. 1 for the fibers 90 to be deposited on the sliding wall (fiber guiding surface 10) of the spinning rotor 1 in such manner that the paths of the individual fibers 90 do not interfere with each other. This is achieved in that the fibers 90 are spread out before leaving the fiber feeding channel 3 within the latter along a contour line (parallel to the plane passing through the fiber collection groove 11) and are fed in this form to the fiber guiding surface 10 of the spinning rotor 1. The fibers 90 glide in this manner along helicoidal paths at distances from each other along the fiber guiding surface 10 into the fiber collection groove 11.

In order to spread out the fibers 90 in the circumferential sense of the spinning rotor 1 parallel to a contour line of the spinning rotor 1, provisions are made for a wall of the fiber feeding channel 3 constituting a fiber distribution surface 300 to extend in the area of the outlet of said fiber feeding channel 3 along a contour line of the spinning rotor 1.

The fibers 90 must be fed to this fiber distribution surface 300 and must be compressed so that they may be conveyed along it to the spinning rotor 1. To achieve this, the next-to-last part (next-to-last longitudinal section 31) of the fiber feeding channel 3 and the last part (longitudinal section 30) of the fiber feeding channel 3 are placed at an obtuse angle α in relation to each other as shown in FIG. 1, in such a manner that the extension 311 of the center line 310 of the next-to-last longitudinal segment 31 of the fiber feeding channel 3 intersects the fiber distribution surface 300 of the last longitudinal segment 30 of the fiber feeding channel 3.

This fiber distribution surface 300 of the last longitudinal segment 30 of the fiber feeding channel 3 is here essentially perpendicular to the plane of the drawing (plane E in FIG. 5) which goes through the center lines 301 and 310.

The fibers 90 which go from the opener roller 74 into the fiber feeding channel 3 in a known manner are hurled as a result of their centrifugal force in the direction of the fiber distribution surface 300 which extends essentially at a right angle to the direction in which the fibers are conveyed until then. As a result of this hurling, the fibers 90 are compressed and spread out on a plane, i.e. on this fiber distribution surface 300 and now move along this fiber distribution surface 300 to the outlet opening 302 where the fibers 90 leave the fiber feeding channel 3 in the form of a fine fiber veil. The conveying air is deflected sharply in a known manner and leaves the spinning rotor 1 between the open edge 12 and the rotor cover 2. The fibers 90, on the other hand, are hurled against the inner wall (fiber guiding surface 10) of the spinning rotor 1 due to their inertia, and thereby reach this fiber guiding surface 10 as a result of the previous spreading out of the fibers essentially at the contour line, parallel to the plane going through the fiber collection groove 11. As stated earlier, the fibers 90 are now able to glide along parallel paths into the fiber collection groove 11 of the spinning rotor 1 without hindering each other.

Thanks to this unhindered and unimpeded gliding of the fibers 90 into the fiber collection groove 11, the fibers 90 are deposited uniformly in the fiber collection groove 11 and thereby constitute also a uniform fiber ring 91. This has as its result that the forming yarn 92 is also uniform. This not only results in a decrease of the otherwise usual irregularities in yarn 92, but also results in a greater resistance to tearing. Other yarn characteristics such as elasticity, etc. are also improved.

Figure 2:
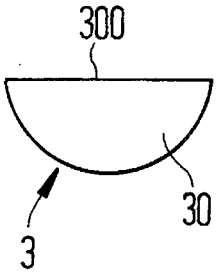
FIGS. 2 to 4 show different embodiments of the last longitudinal segment of the fiber feeding channel according to the invention, in cross-section.
Figure 4:
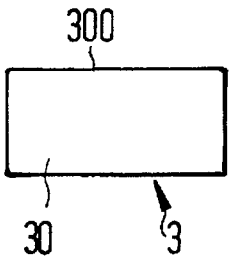

The described device can be designed with many variations within the framework of the instant invention, e.g. by replacing individual characteristics by equivalents or by other combinations thereof. Thus the fiber distribution surface 300 of the fiber feeding channel 3 can be designed in different manners. FIG. 2 shows a configuration of the cross-section of the last longitudinal segment 30 of the fiber feeding channel 3 in which the fiber distribution surface 300 is essentially a flat surface, i.e. a plane surface. According to FIG. 4, this fiber distribution surface 300 is also essentially a plane surface, but the cross-section of this longitudinal segment 30 is not a partial circular surface but is essentially a rectangular surface.

Figure 3:
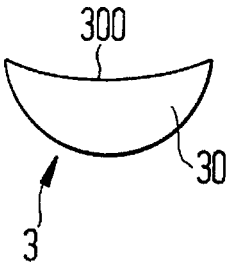

FIG. 3 shows a variant of this fiber distribution surface 300 which is made in form of a convex surface. The fiber, air stream is directed upon the fiber distribution surface 300 so that it reaches this fiber distribution surface 300 essentially within plane E. The fiber stream now spreads out laterally, whereby this spreading action is accelerated by the convex curvature. A distribution surface designed in this manner is therefore especially advantageous when only a short path within the last longitudinal segment 30 of the fiber feeding channel 3 is available for fiber distribution.

Figure 5:
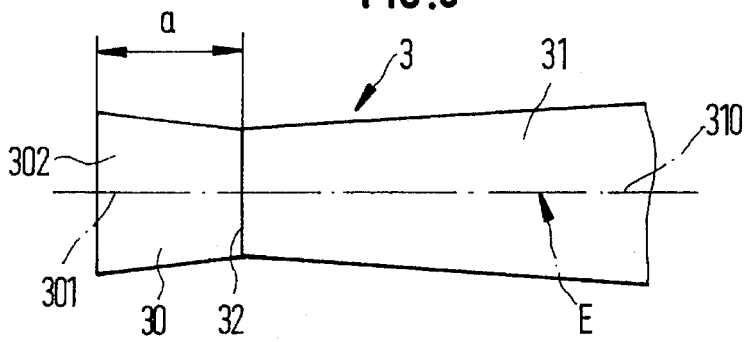
FIG. 5 shows a fiber feeding channel according to the invention, in a longitudinal section.

FIG. 5 shows a longitudinal section through a fiber feeding channel 3, whereby the section extends along the center lines 310, 301 (FIG. 1) perpendicular to the plane of the drawing. As can be seen here, the longitudinal segment 31 tapers in the usual manner along the plane of the drawing (plane E) of FIG. 1, but widens along the plane of the drawing of FIG. 5, so that the fiber distribution surface 300 also widens and the distance from the next-to-last longitudinal segment 31 gradually increases so that the fibers 90 are able to spread out up to the outlet opening 302 of the fiber feeding channel 3.

It has been shown that the fiber guiding surface constituted by the fiber distribution surface 300 must not be too long. The length a of this fiber distribution surface 300 should be at most as long as the length (average staple length) of the fibers 90 to be spun.

On the other hand, the fiber distribution surface should not be too short so that the fibers 90 may be able to spread out effectively. It has been shown to be advantageous for the two longitudinal segments 31 and 30 of the fiber feeding channel 3 to be designed and positioned in relation to each other in such a manner that not only the prolongation of the center line 310 will intersect the fiber distribution surface 300, but also so that the entire projection of the next-to-last longitudinal segment 31 will fall on the fiber distribution surface 300 of the last longitudinal segment 30.

The sliding wall of the spinning rotor 1 constitutes a fiber guiding surface 10 onto which the fibers 90 leaving the fiber feeding channel 3 are fed. It is however not required that the fibers 90 leaving the fiber feeding channel 3 be fed directly to the spinning rotor 1 and that the fiber guiding surface 10 be part of the spinning rotor 1. It is rather possible for the fibers to first reach a fiber guiding surface (not shown) which is independent of spinning rotor 1 and ends in such a manner that the fibers moving along this fiber guiding surface reach the sliding wall (second fiber guiding surface 10) of the spinning rotor 1 in order to slide into the collection groove 11.

The deflection of the fiber feeding channel 3 at the transition from longitudinal segment 31 to longitudinal segment 30 should not be too great. Optimal results can be achieved when an angle $\alpha$ between the two longitudinal segments 31 and 30 of the fiber feeding channel 3 is between 10° and 30°.

An embodiment in which the fiber stream is not yet bunched along a wall of the fiber feeding channel 3 running parallel to the plane of the drawing before reaching the longitudinal segment 31 further contributes to this optimization. For this reason FIG. 5 shows that the center lines 300, 301 of all the longitudinal segments, and therefore also the center lines of the longitudinal segments 31 and 32 of preceding longitudinal segments of the fiber feeding channel 3 are placed in one and the same plane E. A deflection before the angle $\alpha$ within plane E on the other hand is of no consequence for the spreading of the fibers and can even facilitate the spreading of fibers with a corresponding configuration of the fiber feeding channel 3.

In a simple embodiment of a fiber feeding channel 3 of the described kind which may also be retrofitted, it is possible to insert a sheet metal insert 5 extending at a right angle to the plane E defined by the center lines 301 and 310 into an existing rotor housing cover 2. The sheet metal insert 5, with its portion extending into the interior of the fiber feeding channel 3, thus constitutes the fiber distribution surface 300. The longitudinal segment of the fiber feeding channel 3 into which the sheet metal insert 5 extends constitutes the last longitudinal segment 30 of the fiber feeding channel 3, while the preceding longitudinal segment thus constitutes the next-to-last longitudinal segment 31. It is possible here for the fiber feeding channel 3 itself to follow a straight path in the area of these two longitudinal segments 30 and 31, i.e. without taking the sheet metal insert 5 into consideration. Here too the result is that the fibers 90 spread out on the fiber distribution surface 300 of the fiber feeding channel 3 and reach the fiber guiding surface 10 of the spinning rotor 1 in the form of a fiber veil. Thanks to the strong air stream which leaves the fiber feeding channel 3 at its outlet opening 302, the fibers 90 are immediately oriented in the radial direction relative to the spinning rotor 1 as they leave the fiber feeding channel 3, so that the fibers 90 are conveyed in that direction and therefore practically in a radial plane to the fiber guiding surface 10 (gliding wall) of the spinning rotor 1. The advantages are therefore the same as described earlier.

Figure 6:
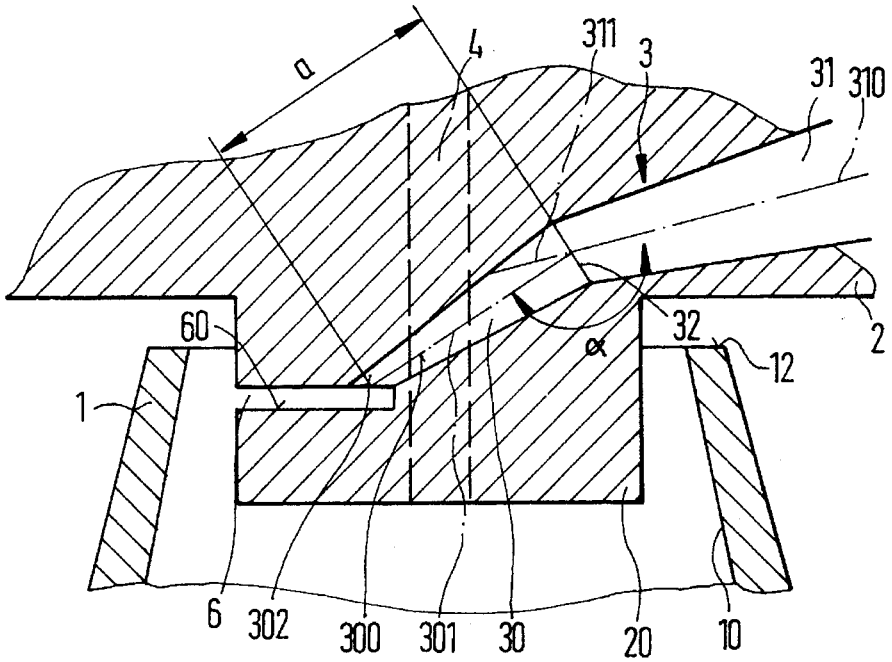
FIG. 6 shows a cross-section of a variant of the open-end spinning device according to the invention.

FIG. 6 shows another embodiment of the described device in which the fiber feeding channel 3, or its last longitudinal segment 30, lets out into a narrow radial slit 6 which ensures that the fibers 90 leaving the fiber feeding channel 3 are fed in radial direction to the circumferential wall (fiber guiding surface 10) of the spinning rotor 1. This radial slit 6 is provided with a surface 60 for the spreading out of fibers across from the fiber distribution surface 300 which extends in the direction of the fiber guiding surface 10 of the fiber feeding channel 3 or towards another fiber guiding surface (not shown) placed before the spinning rotor 1, as seen in the direction of fiber conveying. The fibers are conveyed in the form of a fiber veil to this fiber guiding surface 10 which compresses and spreads out these fibers 90 a second time and thereby widens the fiber veil in the circumferential sense of spinning rotor 1. As a result the spreading out of the fibers 90 is intensified and thereby the basis for further improvement of the fiber deposit in the fiber collection groove 11 of the spinning rotor 1 is provided.

Figure 15:
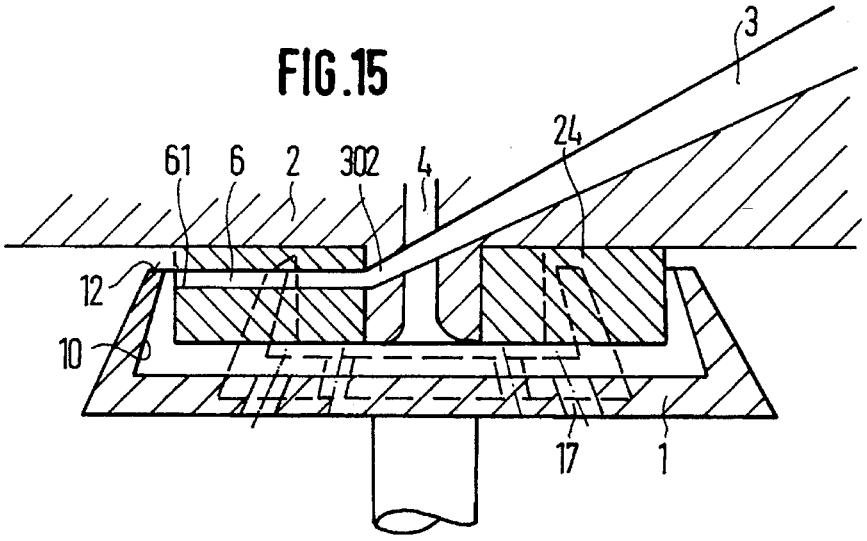
FIG. 15 shows a radial slit according to the invention located at least in part in an adaptor.

In FIG. 6 the fiber feeding channel 3 lets out in a radial slit 6. As FIG. 15 shows, it is not absolutely necessary here to provide a fiber distribution surface 300 in addition to the surface 60 for the spreading out of fibers and preceding the latter, but the combination of a fiber distribution surface 300 and a surface 60 for the spreading out of fibers is especially advantageous when space is at a minimum, i.e. with small rotor diameters, since the surface 300 collects the fibers 90 and feeds them in the form of a compressed veil in the axial direction of spinning rotor 1 to the surface 60 for the spreading out of fibers which again compresses the fibers 90 in the axial direction of the spinning rotor 1 and continues the spreading out of the fibers 90. In this manner the fibers 90 are distributed in the form of a thin veil over a large area of the spinning rotor 1.

It may often suffice, as indicated earlier, if only one fiber distribution surface 300 or one surface 60 for the spreading out of fibers is provided. An embodiment with the fiber distribution surface 300 in the fiber feeding channel 3 having already been described above, a description of an embodiment in which only a surface 60 for the spreading out of fibers as part of a radial slit 6 is provided (FIGS. 8 and 11) shall be described below.

This radial slit 6 is again installed in the extension 20 of the rotor housing cover 2 in which the fiber feeding channel 3 lets out and whose outlet opening 61 is oriented towards the fiber guiding surface 10 of the spinning rotor 1. The radial slit 6, as seen parallel to the rotor axis 15, is delimited by a first fiber guiding surface constituting a surface 60 for the spreading out of fibers, as well as by a second guiding surface 62.

Figure 11:
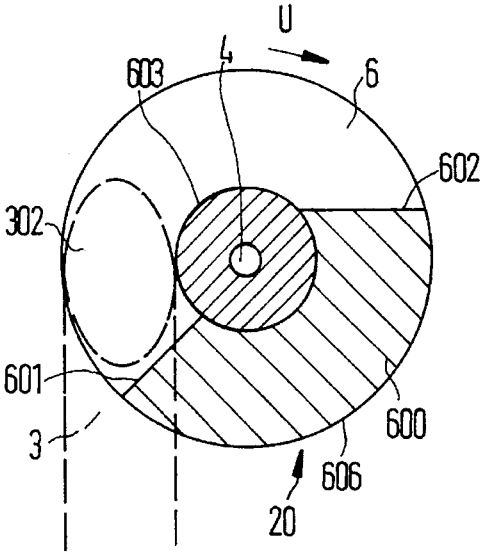
FIGS. 11 to 14 show a cover extension in cross-section, with radial slits of different design, according to the invention.

FIG. 11 shows a section through Fig.8 along the plane IV—IV. As a comparison between FIGS. 8 and 11 shows, the radial slit 6 extends over more than half the circumference of the extension 20 and thereby over a substantial portion of the circumference of the spinning rotor 1.

The height h (see FIG. 10) of the outlet opening 61 of the radial slit 6 (measured parallel to the rotor axis 15) is less than the height H of the fiber feeding channel 3 (measured perpendicular to the channel axis) in the area of its outlet opening 302.

A fiber sliver 9 to be spun is presented in the usual manner to the feeding device 7 which feeds the fiber sliver 9 to the opener roller 74. The opener roller 74 combs individual fibers 90 from the forward end of the sliver and these fibers 90 enter the fiber feeding channel 3 and go from there into the radial slit 6. Due to the narrowness of the radial slit 6 at height h and also due to the extension of the radial slit 6 over a large portion of the rotor circumference, the fibers 90 emerging from the fiber feeding channel 3 and being fed to the radial slit 6 are first compressed in the direction of the rotor axis 15, i.e. according to FIGS. 6, 8, 10 and 15 parallel to the plane going through the fiber collection groove 11 of the spinning rotor 1 and are furthermore spread out in direction of rotation U of the spinning rotor 1 (see FIG. 11). The fibers 90 which emerge from the outlet opening 6 of the radial slit 60 constitute a thin veil and are deposited over a substantial portion of the circumference of the spinning rotor 1 at a defined contour line 16 on the fiber guiding surface 10 of the spinning rotor 1. Because of the high rotational speed of the spinning rotor 1, the fibers 90 deposited on the fiber guiding surface 10 are subjected to a high centrifugal force so that the fibers 90 slide on the fiber guiding surface 10 into the fiber collection groove 11 where they constitute a fiber ring 91 in a known manner. The end of a yarn 92 which is continuously withdrawn from the spinning rotor 1 by the draw-off device 8 is in contact with the fiber ring 91 and thereby spins said fiber ring 91 continuously into itself. The yarn 92 withdrawn by the draw-off device 8 from the spinning rotor 1 is wound up on a bobbin in the usual manner, not shown here.

Good spreading of the fiber stream is not only achieved through the geometry of the radial slit 6, but in particular through the way in which the fiber feeding channel 3 lets out into the radial slit 6. It is essential for the entire fiber stream emerging from the longitudinal segment 30 to reach the surface 60 for the spreading out of fibers across from the fiber feeding channel 3, so that the impact of the fiber stream on the surface 60 for the spreading out of fibers of the radial slit 6 causes the entire fiber stream to be compressed and spread out. The surface 60 for the spreading out of fibers is therefore placed so that the projection of the last longitudinal segment 30 of the fiber feeding channel 3 in the direction of its longitudinal axis (center line 301—see FIG. 1) falls entirely onto the surface 60 for the spreading out of fibers. Otherwise part of the fiber stream would not be deflected and spread out, and this would obviously result in turbulence and ravelled fiber deposit. The improvement of yarn quality which is surprisingly achieved in this manner may be explained by the fact that the above-described measures result in very precise yarn guidance so that the individual fibers 90 hinder each other less than is apparently the case with a thicker fiber stream having a greater height H. If insufficient deflection and spreading of the fiber stream is achieved, fibers cross each other so that the fibers 90 which have already spread out are disturbed in their orientation.

On their way from the opener roller 74 into the spinning rotor 1, the fibers 90 are conveyed in an air stream produced by a negative-pressure source connected to line 14. This conveying air leaves the spinning rotor 1 by passing over the open edge 12 of the spinning rotor 1 while the fibers 90 are deposited at contour level 16 of the spinning rotor 1. As FIG. 10 shows, the air must be deflected considerably to be removed over the edge 12 of the spinning rotor 1.

Because the fiber stream in the radial slit 6 was strongly compressed in the radial slit 6 due to the low height h of the outlet opening 61 and was furthermore spread out in the direction of rotation U of the spinning rotor 1 together with the conveying air, the speed of the air has been reduced considerably. As a result the influence of the air which interferes with the fibers 90 in the fiber veil is decreased.

Figure 9:
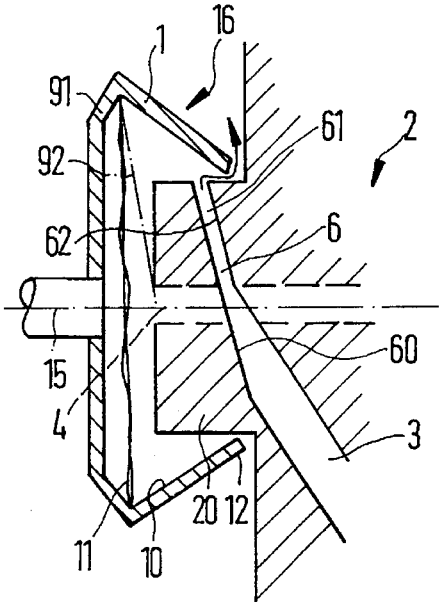
FIGS. 9 and 10 show a detail of the device shown in FIG. 8, in different embodiments, in cross-section.
Figure 10:
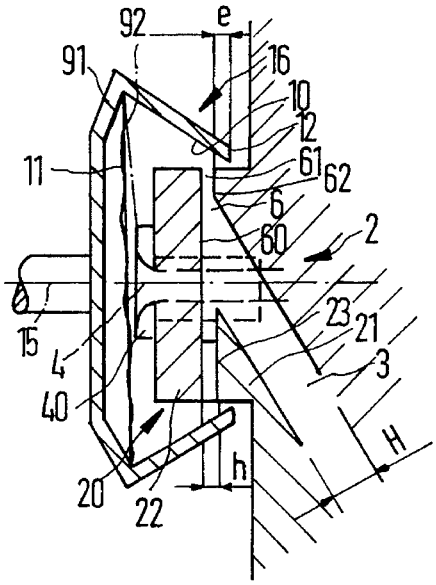

As a comparison between FIGS. 9 and 10 shows, the air must be deflected more strongly in an embodiment according to FIG. 9 than in an embodiment according to FIG. 10 so that the danger of the air carrying along fibers 90 is extraordinarily small. The strip on which the fibers 90 reach the fiber guiding surface 10 of the spinning rotor 1 is however narrower when the fibers 90 are fed on the fiber guiding surface 10 of the spinning rotor 1 according to FIG. 10, parallel to the plane going through the fiber collection groove 11. The fibers 90 are conveyed into proximity of the fiber guiding surface 10 in the embodiment according to FIG. 10, while in the embodiment according to FIG. 9 they must apparently cover a longer, unguided distance to the fiber guiding surface 10.

Surprisingly, the yarn values are optimized if the fiber veil is fed to the fiber guiding surface 10 as close as possible to the open edge 12 of the spinning rotor 1. Since the air stream being sucked away over the open edge 10 of the spinning rotor 1 apparently does not interfere with the conveyed fibers 90, hardly any fiber losses occur. It is possible to place the outlet opening 61 of the radial slit 6 at a very short distance e from the open edge 12 of the spinning rotor 1. This distance e is measured between the guiding surface 62 of the radial slit 6 which is turned away from the plane going through the fiber collection groove 11 and the open edge 12 of the spinning rotor. The distance e depends in particular on the height h of the radial slit 6. The smaller this height h of the radial slit 6, the better is the compression of the fiber stream and the guidance of the fibers 90 on the fiber guiding surface 10 of the spinning rotor 1, so that this distance e can be kept smaller because of the lesser dispersion of the fiber veil. As a rule, a distance e measuring at least one third of the height h of the radial slit 6 between the guiding surface 62 of the radial slit 6 away from the plane going through fiber collection groove 11 and the open edge 12 is sufficient.

As mentioned earlier, the height h of the radial slit 6 is very small. It must, however, be ensured that the required fiber through-put which in turn depends on the yarn number is provided. The thicker the yarn 92 to be produced, i.e. the greater the yarn number, the more fibers 90 must also be fed into the spinning rotor 1 and the greater as a rule must be the height h of the radial slit 6. If on the other hand a finer yarn is to be spun, fewer fibers 90 are to be fed, and a smaller height h can be selected accordingly.

The fibers 90 leaving the outlet opening 302 of the fiber feeding channel 3 are guided to the surface 60 for the spreading out of fibers and glide along surface 60. As they are transferred to the fiber guiding surface 10 of the spinning rotor 1, a motion component in the direction of the fiber collection groove 11 is imparted to the fibers as a result of the centrifugal force. Because of this motion component and the fact that the fibers 90 have been guided to the surface 60 for the spreading out of fibers, the surface 60 for the spreading out of fibers exerts a retention force upon the fibers 90 while at the same time the rotating fiber guiding surface 10 exerts traction on the fibers 90. In this manner a straightening force acts upon the fibers 90, and this considerably promotes parallel depositing of the fibers 90 in the fiber collection groove 11.

In order to achieve an especially effective deceleration of the air stream leaving the fiber feeding channel 3, it is necessary for the air to be able to expand over a cross-sectional range which is greater than the cross-section of the fiber feeding channel 3 at its outlet opening 302. For this reason the cross-section of the radial slit 6 is greater near its outlet opening 61 than the cross-section of the fiber feeding channel 3 near its outlet opening 302, and is as much as possible a multiple of its cross-sectional surface. It need not however be an integral multiple.

Figure 12:
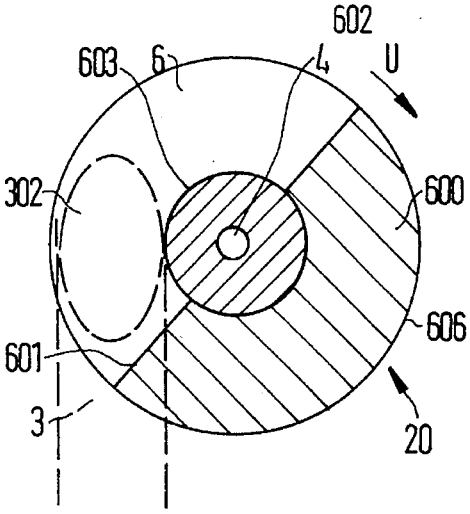

This relatively large cross-section at the outlet opening 61 of the radial slit 6 is achieved through suitable sizing of the radial slit 6 in the direction of rotation U of the spinning rotor 1, since its height h should be as small as possible. As a comparison between FIGS. 11 and 12 shows, the radial slit 6 may be made in different sizes and may extend over different angles. While the radial slit 6 extends merely over 180° as shown in FIG. 12, this angle is considerably greater in FIG. 11 and could possibly extend even over the entire circumference (360°). If the selected angle over which the radial slit 6 extends is greater, the height h of the radial slit 6 can be held down to a smaller dimension.

It has been shown that it is advantageous for the radial slit 6 to cover less than 360°. The radial slit 6 is constituted by a slit delimitation 600 and by the side walls 601 and 602 delimiting the radial slit 6 before and after the outlet opening 302 of the fiber feeding channel 3 and extending substantially at a parallel to the rotor axis 15 and reach as far as the proximity of the fiber guiding surface 10 of the spinning rotor 1. This slit delimitation 600 may be located at different locations in the extension 20 of the rotor housing cover 2 with respect to the outlet opening 302 of the fiber feeding channel 3, e.g. merely in the area behind the outlet opening 302 of the fiber feeding channel 3, as seen in the direction of rotation U of the spinning rotor 1.

Figure 13:
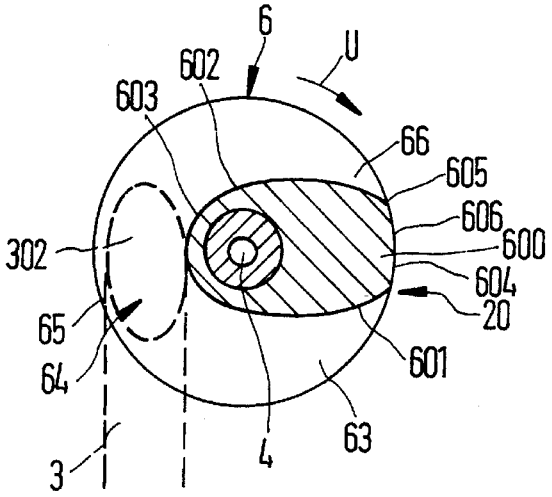

The slit delimitation 600 extends for different distances in FIGS. 11 to 13 in the direction of the outlet opening 302 of the fiber feeding channel 3. According to FIGS. 11 and 12, the side wall 601—as seen in the direction of rotation U of the spinning rotor 1—is located directly behind the outlet opening 302 of the fiber feeding channel 3, while in FIGS. 14 it is next to, and in FIG. 13 essentially across from the outlet opening 302 of the fiber feeding channel 3. Depending on rotor diameter, negative pressure conditions, etc., one design is especially advantageous in one case, and another design in another case, but it has been shown to be advantageous if at least part of the slit delimitation 600 extends over the area which is diametrically across from the outlet opening 302 of the fiber feeding channel 3.

The slit delimitation 600 extending into proximity of the fiber guiding surface 10 of the spinning rotor 1 causes the air which conveys the fibers 90 and which emerges from fiber feeding channel 3 to be forced gradually and radially outward into proximity of the fiber guiding surface 10 (gliding wall) of the spinning rotor 1 so that the fibers 90 are conveyed to the fiber guiding surface 10. The fibers 90 conveyed to the fiber guiding surface 10 are deposited on it and are thus prevented from going around several times in the spinning rotor 1.

The slit delimitation 600 may be given different configurations, as is demonstrated by comparing the FIGS. 11 to 14. According to FIGS. 11 and 12, the side walls 601 and 602 are essentially straight, and are easily produced by milling. These straight side walls 601 and 602 are connected to each other via a convex surface 603. This convex surface 603 can also be constituted here by the yarn draw-off pipe containing the fiber draw-off channel 4.

Figure 14:
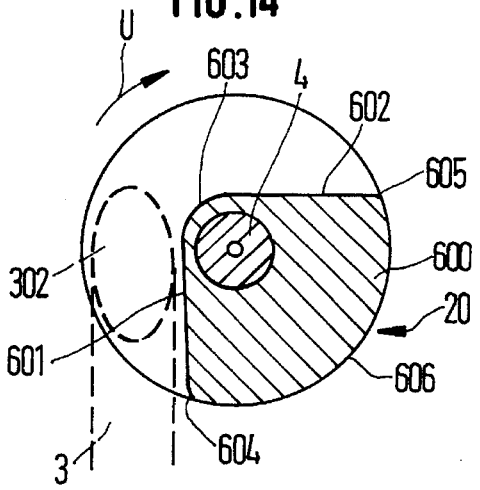

Even more advantageous than the embodiment of the slit delimitation 600 shown in FIGS. 11 and 12, is the slit delimitation shown in FIG. 14. It is part of the projection or extension 20 which consists of two parts 21 and 22 (see FIG. 10). Part 21 is here an integral part of the rotor housing cover 2, while part 22 is a replaceable element connected removably to it. The separation line 23 between parts 21 and 22 is here located in the plane of the guiding surface 62 of the radial slit 6 towards the rotor housing cover 2, so that the replaceable element (part 22) is touching the rotor housing cover 2 with its end away from the spinning rotor 1. The fibers 90 emerging from the fiber feeding channel 3 are guided in this manner upon a guiding surface of the radial slit 6 constituting a surface 60 for the spreading out of fibers. There is no danger in this case for the fibers 90 to come into proximity of the separation line 23 and to be caught at that point.

The radial slit 6 is not delimited on both side by one and the same component as in the embodiment shown in FIG. 15, but borders on one side on a part bearing a replaceable element (part 22) and is delimited in axial and opposite direction and also laterally by this replaceable element (part 22).

The replaceable element (part 22 of the projection or extension 20 of the rotor housing cover 2) is slid on a yarn draw-off nozzle 40 which is screwed into the part 21 of extension 20. The yarn draw-off nozzle 40 merges into the yarn draw-off pipe containing the fiber draw-off channel 4 and can be regarded as being functionally a part thereof.

In the embodiment of the slit delimitation 600 described above through FIGS. 10 and 14, the convex surface 603 is not constituted by the yarn draw-off pipe constituting or containing the yarn draw-off channel (or by the yarn draw-off nozzle 40), but by the same component which also constitutes the side walls 601 and 602. Also, in this manner no slits into which fibers 90 may enter are formed parallel to the rotor axis 15.

In order to avoid turbulence of the air leaving the fiber feeding channel 3 and flowing through the radial slit 6, the side walls 601 and 602 as shown in FIG. 14 merge over rounded corners 604 and 605, i.e. in an arcuate manner, into a connecting wall 606 which is substantially concentric with the rotor axis 15 and is no longer part of the slit delimitation 600.

As shown in FIG. 13, the radial slit 6 may also be delimited by convex side walls 601 and 602. In this case the convexity in side wall 601 increases towards the surface 603 which is near the outlet opening 302 of the fiber feeding channel 3 in FIG. 13, to decrease further on in the side wall 602. Such a design of the slit delimitation 600 which may be of different dimensions in the direction of the circumference of the extension 20, is especially favorable for flow.

Even if a slit extension of less than 180° may be sufficient in individual cases, in particular with low yarn numbers where the fiber stream is thinner than for high yarn numbers, it has nevertheless been shown to be advantageous to select a wider angle than 180° to make it possible to obtain thinner and wider fiber veils. The radial slit 6 should therefore extend as a rule over at least half the rotor circumference, as shown in FIG. 12.

FIG. 13 shows another embodiment of the radial slit 6 which extends over more than half the rotor circumference.

Here the radial slit 6 extends in direction of rotation U of the spinning rotor 1 essentially as far as in the embodiment shown in FIG. 11. By contrast to the embodiment described earlier, the radial slit 6 begins here however already before the outlet opening 302 of the fiber feeding channel 3 into the radial slit 6. The latter begins with a segment 63 which is open radially to the outside. It is followed by another segment 64 which extends to the level of the outlet opening 302 of the fiber feeding channel 3 and which is screened to the outside and radially by a wall 65, so that the segment 64 is designed in the form of a channel. This segment 64 is in turn followed by a segment 66 radially open to the outside. The air stream produced in the spinning rotor 1 is bunched by the segment 64 and thereby its influence upon the fiber stream leaving the fiber feeding channel 3 is increased. This measure also promotes the spreading out of the fiber stream over the circumference of the radial slit 6.

As FIG. 8 shows, it is not absolutely necessary that the guiding surface constituted by the surface 60 for the spreading out of fibers and the guiding surface 64 extend parallel to each other. In FIG. 8 the surface 60 for the spreading out of fibers extends at a parallel to the plane going through the fiber collection groove 11,while the guiding surface 62 is conical so that the radial slit 6 tapers radially towards the outside. It is also possible to make the surface 60 for the spreading out of fibers and the guiding surface 62 with different conicities, whereby the radial slit 6 again tapers to the outside, or else with identical conicities as shown in FIG. 9. The two surfaces intersecting the rotor axis 15 (surface 60 for the spreading out of fibers and guiding surface 62) may however also be not only parallel to each other, but also parallel to the plane going through the fiber collection groove 11, as was explained earlier in connection with a comparison between FIGS. 9 and 10.

The bunched air stream can also be constituted or reinforced by a weak compressed-air stream.

Figure 20:
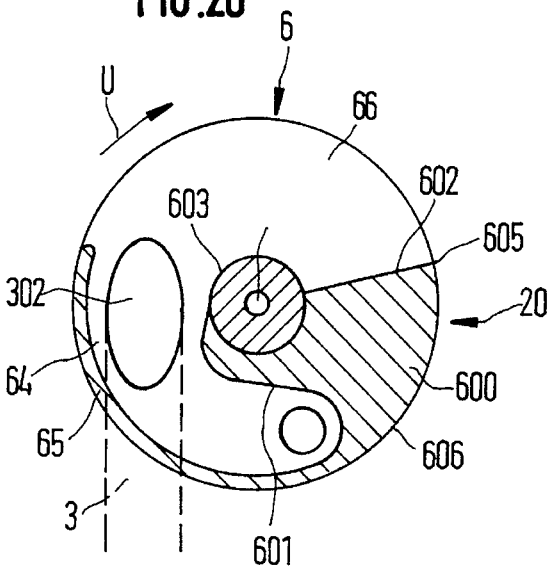
FIG. 20 shows a cover extension in a cross-section, with air guiding channel.

Another embodiment in which a bunched air stream is guided into the radial slit 6 is shown in FIG. 20. Here the slit delimitation 600 merges into wall 65. A bore 630 through which air goes into segment 63 and from there into segment 64 with the outlet opening 302 of the fiber feeding channel 3 lets out into segment 63. Depending on circumstances, this air may be suction air which is aspired because of the negative pressure inside the spinning rotor 1, or it may also be over-pressure which is blown into the radial slit 6.

A relatively strong air stream can be achieved near the outlet opening 302 of the fiber feeding channel 3 by means of an embodiment according to FIG. 20, and this has a positive effect on the produced yarn. This air stream which is forced to pass the outlet zone of the fiber feeding channel 3 is essentially more concentrated (more bunched) than an air stream which passes the outlet zone by means of a device according to FIG. 13, because the air stream, in order to pass the outlet zone of the fiber feeding channel 3, need not flow contrary to the centrifugal force.

The fiber distribution surface 300 of the fiber feeding channel 3 and also the surface 60 for the spreading out of fibers which delimits the radial slit 6 are subject to greater wear because the fibers impact these surfaces and must be deflected by them. In order to increase the life of these surfaces it is therefore advantageous to provide at least one of them, but preferably both of them, with suitable wear protection. The wear protection may be a coating, for example, such as that which is normally used for the fiber guiding surface 10 of the spinning rotor 1 or also for the yarn draw-off nozzle 40. Chrome or diamond coatings can be used, for example. It is also possible to nickel-plate the surface or, if the part with the fiber distribution surface 300 or the surface 60 for the spreading out of fibers is made of aluminum, to anodize it. Other types of wear protection can however also prove to be advantageous.

Figure 7:
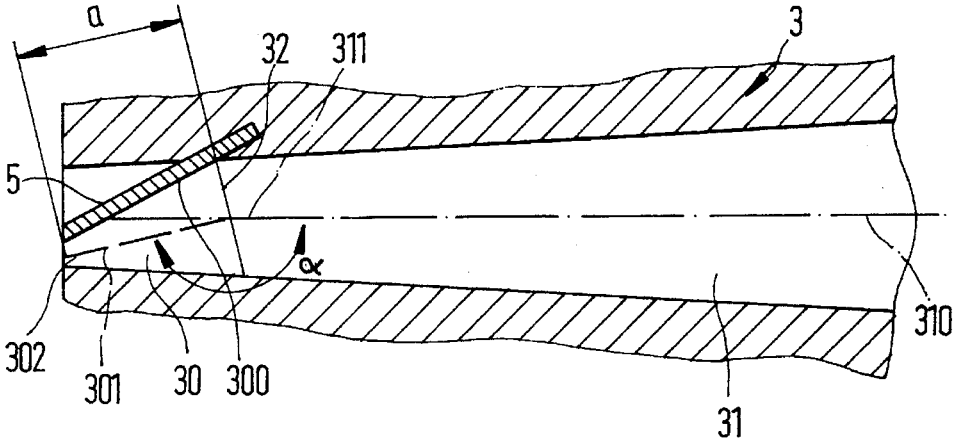
FIG. 7 shows another variant of a fiber feeding channel according to the invention, in longitudinal section.

The type selected does not only depend on its effects with regard to wear protection, but also on its properties with regard to the fibers 90 to be spun. Also the geometry of the parts to be protected play a role here. For instance the interior of the last longitudinal segment 30 of the fiber feeding channel 3 with the fiber distribution surface 300 is not easily accessible. The selection of the wear protection therefore also depends on whether the fiber distribution surface 300 is made in one piece with the remaining circumference of the longitudinal segment 30, or whether it is part of a sheet metal insert 5 (see FIG. 7) or of an insert of another design.

The invention can advantageously and easily be retrofitted with an existing rotor spinning unit or can also be adapted to the applicable rotor diameter. FIG. 15 shows an embodiment in which the radial slit 6 is part of a replaceable element 24. In FIG. 15 the element 24 is a ring placed on the projection or extension 20 of the rotor housing cover 2. The radial slit 6 begins already in the extension 20 which also contains the longitudinal segment 30 of the fiber feeding channel 3. Different ring sizes can be installed in adaptation to the rotor diameter.

Instead of the ring, the entire projection or extension 20 or part thereof (see FIG. 10) may be replaceable. In that case the extension 20 is attached advantageously via part of the yarn draw-off pipe containing the fiber draw-off channel 4 to the rotor housing cover 2.

As shown in FIG. 15, a radial slit 6 of the described design may not only be used to advantage when the negative spinning pressure is produced by means of an external source of negative pressure, but also when the spinning rotor 1 is provided with ventilation openings 17 so that it may itself produce the required negative spinning pressure.

Figure 16:
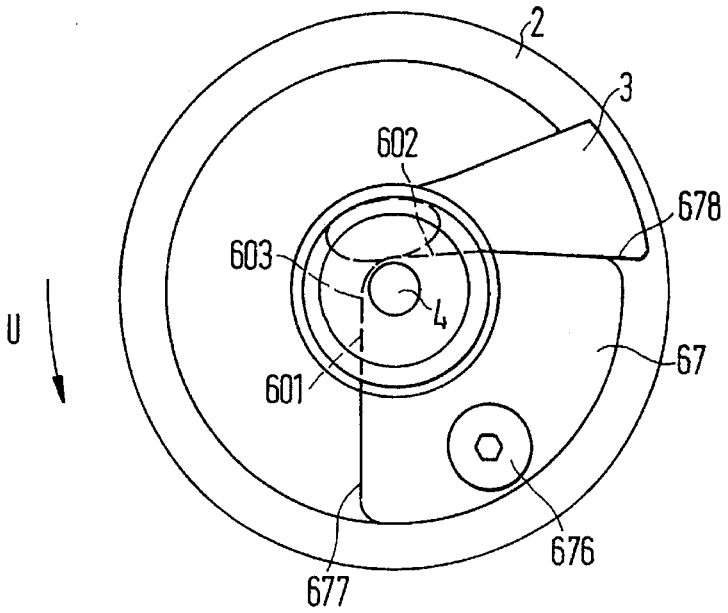
FIGS. 16 and 17 show a top view and cross-section a rotor housing cover extension with a radial slit according to the invention.
Figure 17:
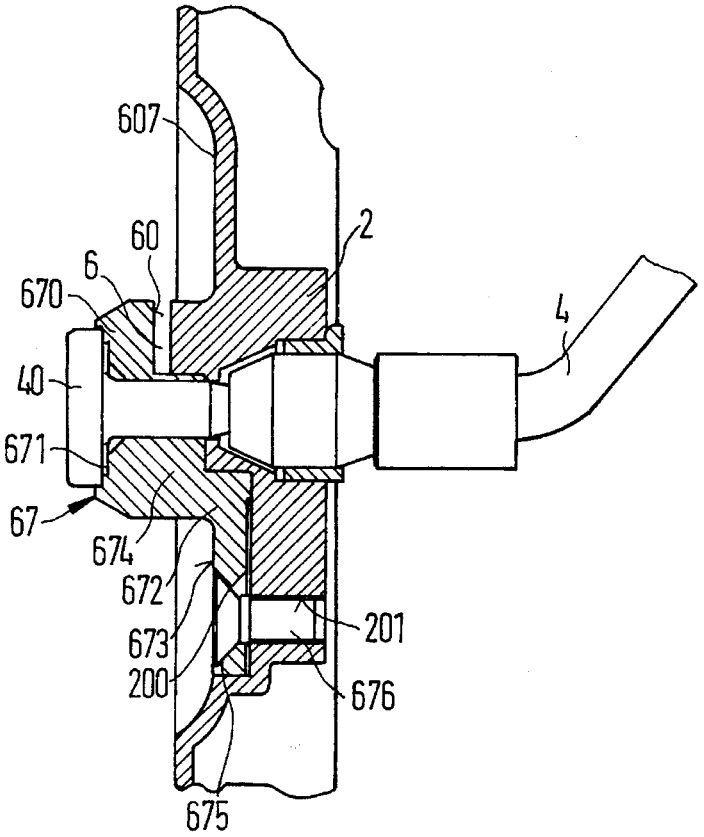

FIGS. 16 and 17 show another embodiment of a rotor housing cover 2 with a radial slit 6 which is substantially the same as in FIG. 14. The side walls 601 and 602 as well as the surface 603 connecting these walls are constituted in this embodiment by a replacement part 67. This replacement part 67 is provided with a head part 670 with the surface 60 for the spreading out of fibers which has a wear-protected surface. The replacement part 67 is provided with a centered recess 671 which widens in the head part 670 on its side away from the rotor housing cover 2. The recess 671 serves to contain the yarn draw-off nozzle 40.

The side walls 601 and 602 as well as the surface 603 are prolonged in radial direction and comprise a ridge 674 between them, on their side away from the radial slit 6. This ridge 674 connects the part with the surface 60 for the spreading out of fibers of the radial slit 6 to an attachment element 672 which extends radially outward. The ridge 674 with the attachment element 672 extends into the rotor housing cover 2 which is provided with a corresponding radial recess 20 extending outward. The attachment element 672 extending radially outward in relation to the head part 670 containing the surface 60 for the spreading out of fibers is thus located before the inlet of the fiber feeding channel 3 as seen in direction of rotation U of the spinning rotor 1.

The attachment element 672 connected to the rotor housing cover 2 is recessed in the rotor housing cover 2 with its part extending radially beyond the diameter of the head part 670, and is set back so far with respect to the head part 670 that its surface 673 towards the spinning rotor 1 is substantially flush with the surface 607 of rotor housing cover 2 which is towards the spinning rotor. In order to make it nevertheless impossible for the fibers 90 to become caught at the edges of the side walls delimiting the recess 200 and the attachment element 672, the radial walls 677, 678 of the attachment element 672 and the walls of the recess 200 adjoining these radial walls 677, 678 are provided with rounded edges on their side toward the spinning rotor 1.

The replacement part 67 is connected to the rotor housing cover 2 by means of its attachment element 672. For this purpose the attachment element 672 is provided with a bore 675 through which a screw 676 extends, said screw being screwed into a threaded bore 201 of the rotor housing cover 2. The replacement part 67 is here fixed in its precise position by the sidewalls of recess 200 interacting with its lateral walls 601 and 602.

As shown in FIG. 16, the radial walls 677 and 678 of the attachment element 672 are placed essentially in prolongation of the lateral walls 602 and 603 delimiting the radial slit. This allows for easy fabrication. Only the side walls 602 and the radial wall 678 are not precisely aligned with each other because of the fiber feeding channel 3 which is provided here. But these surface can also be placed in precise alignment with each other in that these walls 602 and 678 are placed at a somewhat greater distance from the fiber feeding channel 3.

In the embodiments shown in FIGS. 6, 8 and 9, the radial slit 6 is located in the extension 20 of the rotor housing cover 2. An embodiment according to FIG. 15, according to which the radial slit 6 is located in a replaceable element 24, is however more advantageous. An embodiment of the radial slit 6 according to FIGS. 10 and 16/17, according to which the radial slit 6 is delimited merely by the surface 60 for the spreading out of fibers of a replaceable part 22 (FIG. 12) or of a replacement part 61 is however easier to fabricate, in particular in view of the wear protection which may be provided.

Figure 18:
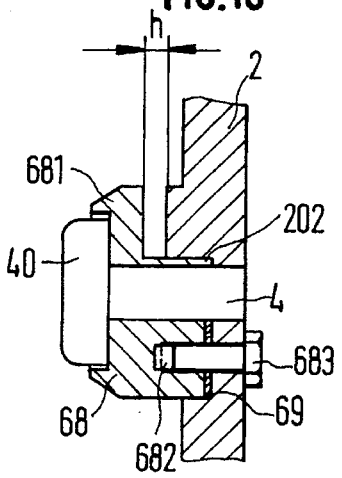
FIGS. 18 and 19 show cross sections of radial slits of different width according to the invention.
Figure 19:
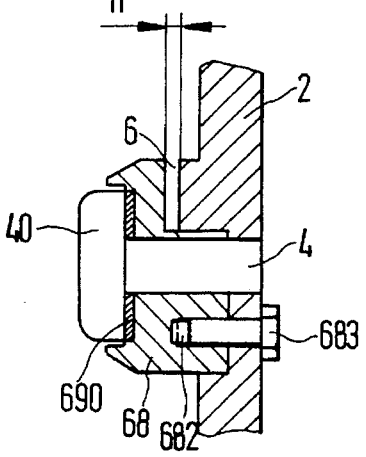

As mentioned earlier, it is advantageous for the height h of the radial slit 6 can be adapted to the yarn thickness (yarn number). The simplest way to accomplish this is for the height h to be adjustable, since in that case it is possible to forego a replacement of the part containing or delimiting the radial slit 6 (e.g. part 22 in FIG. 10 or element 24 in FIG. 15). FIGS. 18 and 19 show an embodiment by means of which such a height adjustment of the radial slit 6 can be effected. According to FIG. 18, a replacement part 68 having a substantially round outer contour near its head piece 680 is replaceably attached to the rotor housing cover 2. Near the radial slit 6, the replacement part 68 has again side walls 601 and 602 which are oriented in the desired manner, e.g. as shown by one of the FIGS. 11 to 14. As previously in the embodiment explained through FIGS. 16 and 17, the sidewalls 601 and 602 are extended here too in the direction of the rotor housing cover 2, so that the replacement part 678 extends into a corresponding recess 202 of the rotor housing cover 2. Centered in the replacement part 68 is part of the fiber draw-off channel 4 which is continued in the rotor housing cover 2 or in a yarn draw-off pipe (see FIG. 17) inserted there. A concentric recess 681 containing a yarn draw-off nozzle 40 is located on the front of the replacement part 68, away from the rotor housing cover 2.

A threaded bore into which a screw 683 extending through the rotor housing cover 2 is provided eccentrically on the face of the replacement part 68 towards the rotor housing cover 2. By rotating this screw 683, the axial position of the replacement part 68 can be adjusted continuously.

As can be seen in FIG. 18, a spacer 69 of desired thickness in the form of a disk can be provided between the rotor housing cover 2 (or some other element supporting the replacement part 69) and the attachment element of the replacement part 68 to fix the slit width. However the position of the yarn draw-off nozzle 40 relative to the rotor housing cover 2 and thereby also relative to the spinning rotor 1 which is in turn located at a given distance from the rotor housing cover 2 also changes.

As a rule however, such a change in the distance between yarn draw-off nozzle 40 and spinning rotor 1 is not desirable. In order to maintain the version of the yarn draw-off nozzle 40 which remains at the same distance from the spinning rotor 1, FIG. 19 provides for a spacer 690 to be inserted into the recess 681 between replacement part 68 and yarn draw-off nozzle 40 when the height h of the radial slit 6 is small, so that this spacer 690 may compensate for the change in height h. For the sake of simplification the spacers 69 and 690 may be one and the same disk which is inserted optionally between the rotor housing cover 2 (or some other element supporting the replacement part 68) and the replacement part 68, or between the replacement part 68 and the yarn draw-off nozzle 40, depending on the desired slit width.

Depending on the size and the number of steps of the height h of the radial slit 6, several spacers 69, 690 in combination with each other or of different thicknesses may be used, to be distributed between the two aforementioned locations depending on the desired height h and the desired position.

Whether the replacement part 67 (FIGS. 16,17) or 69 (FIGS. 18, 19) is adjusted with or without the help of spacers 69, 690, the replacement part 67 or 68 is always provided with at least one guide wall for axial guidance, interacting with a corresponding counter-wall of an element supporting the replacement part 67 or 68, e.g. the rotor housing cover 2. This guide wall or these guide walls are always placed in axial continuation of the lateral walls 601 and 602 of the replacement part 67 or 68 according to the embodiment of FIGS. 16 to 18, and are therefore not designated separately in the figures—with the exception of the radial walls 677 and 678. The counter-wall or walls are constituted by the lateral walls of the recess 200 or 202.

By selecting the location of the separations between the replaceable element 67, 68 or part 22 and the rotor housing cover 2 or some other element to which the replicable element 67, 68 or 22 is attached, the catching of fibers 90 at that location can be avoided.

However, in order to deny so-called escapees among the fibers 90 the opportunity of settling at this point, an additional measure can be taken, consisting in pressing the replaceable element 67, 68 or 22 and its support, e.g. the rotor housing cover 2 firmly against each other by their contact surfaces.

For this purpose a bore can be provided in the replaceable element 67 or 68 to receive the connecting element (screw 676 in FIGS. 19/17 or 686 in FIGS. 18/19), whereby this bore allows for lateral shifts in relation to the connecting element. The replaceable element 67 or 68 is provided with a ramp-like surface (not shown) between the replaceable element 67 or 68 and its side away from its support which interacts with the support. These ramps are inclined in such a manner that the replaceable element 67 or 68 is pressed more firmly with its ramp against the ramp of the support when the connecting element (screw 676 or 683) is tightened more vigorously, whereby the ramp of the support exerts a resulting force in the direction of the interacting surfaces of element 67 or 68 and of the support.

In an alternative embodiment, e.g. according to the examples of embodiments as shown in FIGS. 16 to 19, the desired effect can be achieved in that the replaceable element 67 or 68 is attached to its support by means of a connecting element (screw 676 in FIGS. 16/17 or 683 in FIGS. 18/19) in such a manner that this connecting element exerts a pressure upon the replaceable element 67 or 68 in direction of the interacting guide walls of the replaceable element 67 or 68 and of its support (e.g. rotor housing cover 2). This occurs in the embodiments according to FIGS. 16 to 19 in the simplest manner in that when the replaceable element 67 or 68 is positioned in its operating position, the bore 675 in element 67, as well as the threaded bore 201 or a corresponding bore in the element 68, and the threaded bore 682 are not in precise alignment with each other but are offset to a small, appropriate extent in such manner that the threaded bores 201 or 682 are located closer to the rotor axis 15 than the appertaining bore in the replaceable element 67 or 68 loosely positioned in its operating position. It goes without saying that this offset may not be too great, as otherwise an orderly attachment of the replaceable element 67 or 68 to its support (e.g. the rotor housing cover 2) would not be possible. Such a design always has the desired effect in an identical manner, whether or not the height h of the radial slit 6 can be adjusted.

In the examples of embodiments described above, the side walls 601 and 602 are extended in the direction of the rotor housing cover 2 so that the walls reaching into the recess 202 of the rotor housing cover 2 merge into the mentioned side walls 601 and 602. This is however not an absolute requirement. Rather, it is absolutely possible for the guide walls extending into the recess 202 to be offset in relation to the side walls 601 and 602 and be connected to the latter via a connecting surface (not shown) forming a step.

As mentioned earlier, the fiber feeding channel 3 need not extend into the spinning rotor 1 but alternatively may also be directed upon the inner wall (fiber guiding surface 10) of a conical driven or immobile fiber guiding element (not shown) which lets out inside the spinning rotor 1 with its greater inside diameter. In this case the replaceable element 67 or 68 may be located inside this fiber guiding element and may be supported by the fiber guiding element so that this replaceable element 67 or 68 is not supported by the rotor housing cover 2—or merely with the intercalation of a fiber guiding element.

It will be apparent to those skilled in the art that various modifications and variations can be made in the present invention without departing from the scope or spirit of the invention. For example, features illustrated as part of one embodiment can be used on another embodiment to yield a still further embodiment. It is intended that the present invention cover such modifications and variations as come within the scope of the appended claims and their equivalents.

I claim:

1. An open-end spinning device, comprising:

a spinning rotor, said spinning rotor defining a fiber collection groove;

a fiber feeding channel operatively disposed so as to convey fiber to said spinning rotor, said fiber channel comprising a first longitudinal segment and a second longitudinal segment in communication with and forming an angle with said first longitudinal segment, said second longitudinal segment angled towards said fiber collection groove; and a substantially planar fiber distribution surface disposed within said second longitudinal segment, said fiber distribution surface extending essentially in a plane perpendicular to a plane through the centerlines of said longitudinal segments, wherein fibers emerging from said fiber feeding channel are compressed in a first plane against said fiber distribution surface before being conveyed to said spinning rotor.

2. The device as in claim 1, wherein said fiber distribution surface is configured to be slightly convex.

3. The device as in claim 1, wherein said fiber distribution surface comprises a width which increases from said first longitudinal segment to said spinning rotor.

4. The device as in claim 1, wherein said fiber distribution surface comprises a length which is no longer than the average staple length of fibers to be spun by said open-end spinning device.

5. The device as in claim 1, wherein said fiber feeding channel is tapered along the plane through the centerlines of said longitudinal segments towards said fiber distribution surface.

6. The device as in claim 1, wherein said fiber distribution surface is defined by a wall of said second longitudinal segment.

7. The device as in claim 1, wherein said fiber distribution surface is disposed at such an angle that an axial projection of said first longitudinal segment fall entirely on said fiber distribution surface.

8. The device as in claim 1, wherein said spinning rotor defines a fiber guiding surface.

9. The device as in claim 1, wherein said angle between said longitudinal segments is between generally 10 degrees and 30 degrees.

10. The device as in claim 1, further comprising a plurality of said longitudinal segments, the centerlines of all said longitudinal segments being in the same vertical plane.

11. The device as in claim 1, further comprising a radial slit disposed adjacent said fiber distribution surface, said radial slit defining a fiber spreading surface generally opposite said fiber distribution surface for spreading fibers emerging from said fiber distribution surface radially outward.

12. The device as in claim 11, further comprising a rotor cover having an extension which extends generally into said spinning rotor, said slit being defined in said rotor cover.

13. The device as in claim 12, wherein said second longitudinal segment and said fiber distribution surface are defined in said rotor cover.

14. The device as in claim 11, wherein said fiber spreading surface and said fiber distribution surface comprises a wear resistant surface.

15. The device as in claim 1, wherein said fiber distribution surface comprises a wear resistant surface.

* * * * *

UNITED STATES PATENT AND TRADEMARK OFFICE

CERTIFICATE OF CORRECTION

PATENT NO. : 5,491,966

DATED : February 20, 1996

INVENTOR(S) : Werner Billner

It is certified that error appears in the above-identified patent and that said Letters Patent is hereby corrected as shown below:

Claim 1, column 20, line 2, delete "fiber" and substitute therefor --fibers", (second occurrence) and before "channel" insert --feeding--.

Signed and Sealed this

Fourteenth Day of December, 1999

*Attest:*

*Attesting Officer*

Q. TODD DICKINSON

*Acting Commissioner of Patents and Trademarks*